United States Patent [19]

Rothenberger

[11] 4,081,985

[45] Apr. 4, 1978

[54] TOOL FOR FORMING NECKS ON CIRCUMFERENTIAL SURFACES OF PIPES

[75] Inventor: Günter Rothenberger, Bad Homburg von der Hohe, Germany

[73] Assignee: Rothenberger GmbH & Co. Werkzeuge-Maschinen, Frankfurt am Main, Germany

[21] Appl. No.: 666,117

[22] Filed: Mar. 11, 1976

[30] Foreign Application Priority Data

Mar. 15, 1975 Germany ..... 7508218[U]

[51] Int. Cl.[2] ..... B21D 51/40

[52] U.S. Cl. ..... 72/117; 72/125; 29/157 T

[58] Field of Search ..... 29/157 T; 254/67, 98; 81/57.4; 72/112, 125, 115, 117

[56] References Cited

U.S. PATENT DOCUMENTS

| | | | |
|---|---|---|---|
| 245,678 | 8/1881 | Weaver | 72/115 |
| 1,573,397 | 2/1926 | Grenier | 254/67 |
| 1,985,454 | 12/1934 | McCabe | 72/117 |
| 2,120,497 | 6/1938 | Heinrich | 254/67 |
| 2,511,836 | 6/1950 | Cullen | 29/157 T |
| 3,050,102 | 8/1962 | Hock | 72/117 |
| 3,817,071 | 6/1974 | Chalvignac | 29/157 T |

*Primary Examiner*—Lowell A. Larson

*Attorney, Agent, or Firm*—Burgess, Dinklage & Sprung

[57] ABSTRACT

A necking-out tool for forming projecting cylindrical nipples or necks on the circumferential wall of a pipe container or the like. The tool has a screw plug having a hook-shaped forming head and a thrust sleeve provided with a coaxial downholder flange for cooperation with the forming head and the screw plug. The thrust sleeve also has a hollow cylindrical interior corresponding to the contour of the forming head for the reception of the formed nipple or neck. A non-rotatable, telescopic guide means is associated with the thrust sleeve for mounting a torque converter on the screw plug.

5 Claims, 2 Drawing Figures

TOOL FOR FORMING NECKS ON CIRCUMFERENTIAL SURFACES OF PIPES

BACKGROUND

This invention relates to a necking-out tool for forming projecting cylindrical nipples ("necks") on the circumferential wall of a pipe, container or the like, having a screw plug with a hook-shaped forming head, a thrust sleeve provided with a coaxial downholder flange for cooperation with the forming head and the screw plug and a hollow cylindrical interior corresponding to the contour of the forming head of the reception of the formed neck.

When such a tool is used, a hole is first drilled into the cylindrical hollow body that is to be provided with the nipple ("neck"), the diameter of the hole just permitting the forming head of the tool to be passed through. For this purpose, the forming head is turned far enough out of the thrust sleeve to enable it to be manipulated through the hole by taking advantage of an oblique slot cut into the head. The tool is then re-erected into a radial position in relation to the pipe axis and the forming head is retracted into the thrust sleeve by rotating the screw plug. This operation causes the material of the hollow body to be plastically deformed into the shape of a projecting edge having an external diameter corresponding to the internal diameter of the thrust sleeve. During this forming process, the thrust sleeve bears on the hollow body which takes up the reactive force. A tool of this type and the manner in which it functions is described in U.S. Pat. No. 3,882,707.

The process of forming the neck calls for the application of fairly considerable forces which in magnitude depend on the nature of the material and particularly on the dimensions of the pipe and of the nipple which is to be formed on the pipe. The production of large diameter nipples on pipes which have thick walls requires the generation of forces rather beyond the physical strength of a fitter without special aids. The effort must be applied to the screw plug in the form of a torque. Apart from the purely deforming forces the frictional forces between the forming tool and the material that is to be deformed, as well as the friction between the threads of the screw plug and the thrust sleeve must also be overcome. The torque is usually applied to the screw plug by means of a lever, preferably a ratchet wrench. In view of the space needed for manipulation, it is naturally impossible to arbitrarily extend the length of the lever arm in order to improve the mechanical advantage.

SUMMARY

The invention provides an improved tool that can be used for the production of nipples of large diameters on pipes of major wall thickness and consisting of tough materials without calling for the application of excessively high operating forces to the tool. Manipulation of the tool is also made easier. These are achieved by a tool having a non-rotatable telescopic guide means associated with the thrust sleeve for mounting a torque converter on the screw plug.

DESCRIPTION

Figure 1:
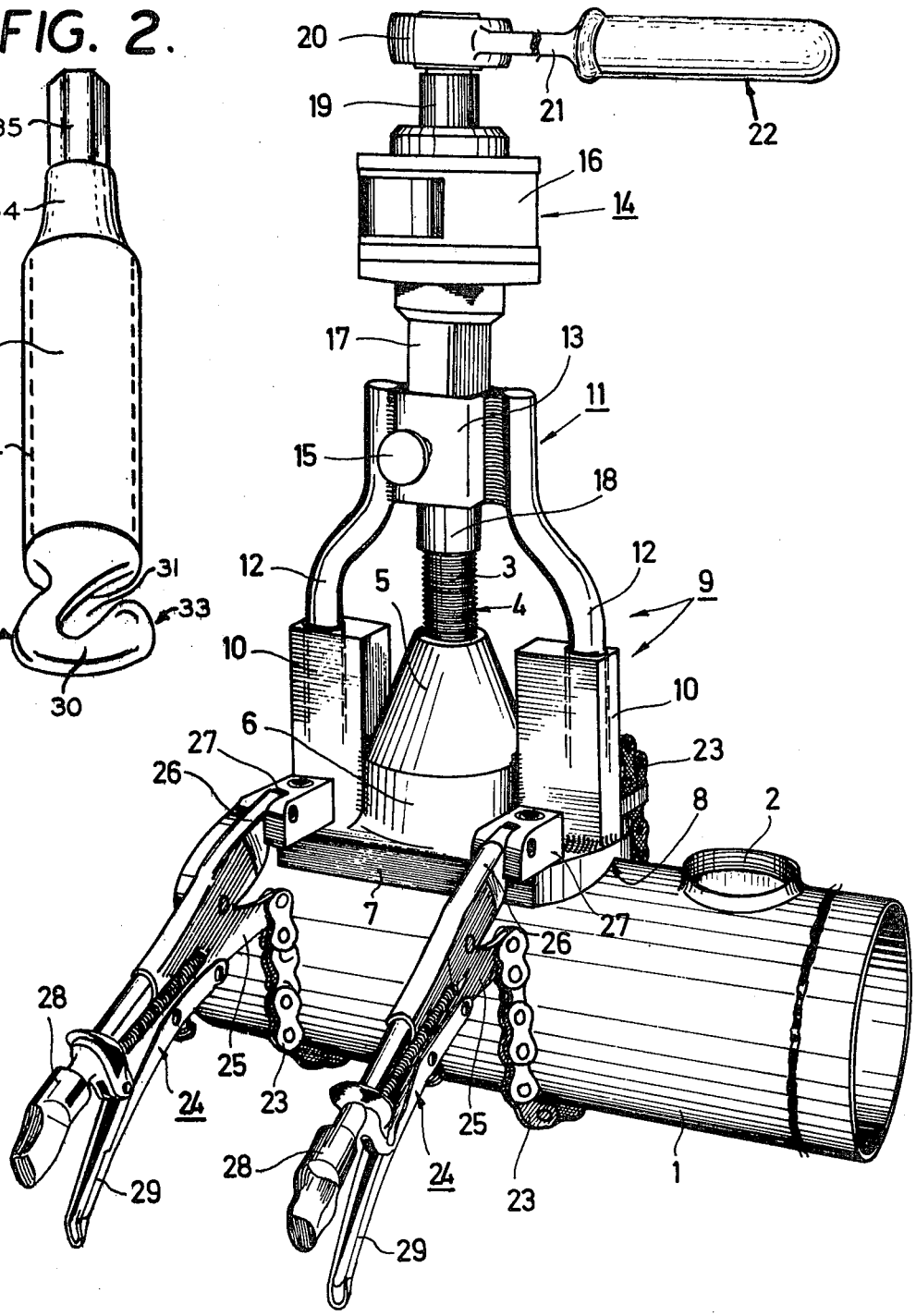
FIG. 1 of the accompanying drawing is a perspective view of the complete improved tool of the invention.

This invention thus provides a compact necking-out tool in which the forces are self-contained, and which permits projecting nipples, i.e., 'necks' to be produced with the application of a relatively small effort on large diameter pipes having thick walls and consisting of a tough material. The magnitude of the applied force can be reduced depending on the transmission ratio of the torque converter. The transmission ratios of commercially available torque converters suitable for this purpose, and which are preferably epicyclic transmissions of axially symmetrical shape, provide gear ratios between about 1 : 2 and 1 : 20. As such, one might consider mounting such a conventional torque converter directly on the screw plug without the provision of additional means. However, during the necking-out process the screw plug shifts in the axial direction, the torque converter has to participate in this movement while being continuously manually held in coaxial alignment with the screw plug. Furthermore, the difference between input and output torque of the torque converter must be absorbed by the converter casing or body. Conventional torque converters are therefore provided with a lateral arm which must be either manually held or allowed to rest against some available fixed abutment. Again, the axial shift of the screw plug during the necking-out process is a problem. Moreover, the necking-out tool which is considerably extended in length to at least twice its former length by the provision of the torque converter then tends to be pulled over sideways and to be tilted by the actuating force. A fitter on his own without help would, therefore, find it impossible to operate a tool composed of a conventional necking-out tool and a torque converter mounted thereon.

The telescopic guide means for holding the torque converter on the screw plug, as provided by the present innovation, has the effect that all externally applied forces are absorbed within the tool itself, including the difference between the input and output torques of the converter as well as the tilting forces due to the lateral application of force by the actuating lever arm. The stable association of the several parts of the tool is maintained throughout the necking-out process, i.e., throughout the axial movement of the screw plug. Consequently, the mechanical advantage afforded by the torque converter can be fully exploited when forming necks on a pipe in which case a loose association of a necking tool with a torque converter would normally cause a great deal of difficulty.

A telescopic guide means which precludes relative rotation can be embodied in various ways. For example, a concentric arrangement of telescopic guideways about the thrust sleeve would be entirely feasible. However, a particularly reliable and simple arrangement comprises telescopic guide means which consist of two tubular members symmetrically attached to the thrust sleeve parallel to the screw plug, a U-shaped stirrup having parallel legs which are slidably received into the tubular members, and a yoke incorporating a fitting for the reception of the torque converter. A stirrup of the proposed kind is a very simple component. For example, the fitting for the reception of the torque converter may consist of a tube section, preferably provided with a clamping screw. Two parallel rod portions may then be affixed to the to the sides to form the stirrup legs that are slidably received into the tubular guide members. The stirrup-shaped geometry of the telescopic guide means permits the progress of the necking-out process to be kept under direct observation since a direct view of the screw plug is not, or is at least only slightly obstructed. The position of the screw plug indicates the stage the necking-out process has reached. Also of particularly simple design is the assembly comprising the thrust sleeve and the tubular guide means. In principle, this consists exclusively of a thrust sleeve to which the tubular guide members are attached, for instance by welding diametrically opposite sides in such a position that the longitudinal axes of the tubular members are parallel to the screw plug axis. It is by means necessary for the tubular guide members to have a circular internal cross section.

The coupling betwen the fitting and the torque converter should have a cross section that deviates from the circular. Conveniently the body of the torque converter may be provided with an extension having an external hexagonal cross section which fits into a corresponding internal hexagonal cross section in the fitting supported by the stirrup. Naturally, the hexagonal cross section could be replaced by a square or an octagonal section. Moreover, a cylindrical extension having a segmental slot or containing a transverse hole for a clamping screw would also be suitable.

Advantageously the legs of the stirrup may be offset outwards in the downward direction. This will permit the tubular guide members to be widely spaced to create a correspondingly wide supporting base, i.e., they may be attached to opposite sides of thrust sleeves of large external diameter in such manner that the stirrup will not be in the way and obstruct the fitter at work.

The prior art tool is generally mounted on the hollow body that is to be deformed, the neck being formed without further ado by turning the screw plug. It has not been suggested to embrace or hold the hollow body or pipe by a suitable back support. When the prior art tool is used it therefore occasionally happens that during the final phase of deformation the forming tool suddenly slips out of the hollow body so that the necking-out operation cannot be properly completed and the branch pipe that is to be joined to the formed nipple fails to fit. Moreover, the thrust sleeve must be tightly held with one hand throughout the necking-out process. In inaccessible positions this causes difficulties and it also requires considerable physical strength which some plumbers or fitters may not possess. The work of producing a "neck" is therefore then liable to take time to bring to completion.

The same problems naturally also arise when using a tool according to the present invention, considering that the length of the tool has been greatly increased by the presence of the torque converter with a consequential increase in the acting lever arm. In order to overcome these difficulties, another feature of the invention involves attaching at least one tensioning chain to one side of the downholder flange in order to secure the thrust sleeve to the pipeline, the other end of the tensioning chain being attached to a tensioning caliper device which is linked to the opposite side of the downholder flange. It is preferred that the tensioning caliper device have the form of a so-called 'gripper tongs.' The end of the tensioning chain is attached to one jaw of such tongs, whereas the other jaw is adapted to be hingeably coupled to a suitable fitting secured to the downholder flange. After the gripper tongs have been provisonally adjusted, the chain can be tightened by pressing together the self-locking handles of the tongs, the thrust sleeve being thus securely tied to the pipe.

The tool of the invention can be quickly and reliably mounted on a pipe that has already been installed, since the tensioning chain can be readily drawn around the circumference of pipes even in less accessible situation. A sudden withdrawal of the forming tool is thus reliably prevented as well as any tendency of the tool to tip as a result of the lever arm effect when the torque converter has been mounted. An accident hazard when a fitter has to work in a constrained position is also eliminated. The necking-out operation is completed reliably and difficulties in fitting the branch pipe will not arise. The thrust sleeve need not be manually held in position and the effort required of the fitter is substantially reduced. A fitter will even have one hand free to steady himself in a constrained situation. Hence, the working speed can be increased because a fitter can concentrate exclusively on what he is doing when he operates a ratchet wrench for turning the screw plug. The tensioning chain also permits different lengths of chain to be secured and the tool to be conveniently adapted to pipes of different diameter. The tool of the invention thus has advantages over prior proposals wherein the pipe is embraced by a heavy body resembling a die having a fixed internal diameter.

An embodiment of the invention will be described with reference to FIG. 1 which shows the entire tool in perspective.

With reference to FIG. 1, a cylindrical nipple 2 projecting from the wall of a pipe 1 has been formed with the aid of a necking-out tool that will be hereinafter described in greater detail. The projecting nipple is intended for fitting or soldering a branch pipe or the like to a main pipeline 1. The branch pipe itself is not shown.

Figure 2:
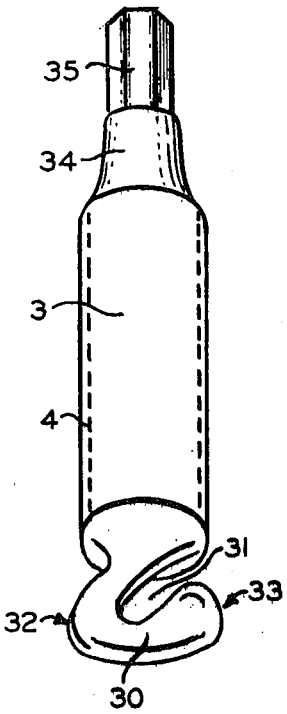
FIG. 2 shows an embodiment of the main, rotating part of the tool, consisting of a screw plug with a hook-shaped forming head.

The tool as such includes a screw plug 3 which is provided with a fine screw thread 4 and which at its end extending into the interior of the pipe 1 carries a forming head shown in FIG. 2. The screw plug 3 works in a thrust sleeve 5 comprising a hollow cylindrical portion 6 and a wider downholder portion resembling a flange 7. The hollow cylindrical portion 6 contains a cylindrical internal bore (not shown) of a diameter and length corresponding to the dimensions of the projecting cylindrical nipple 2 it is desired to form. Moreover, the thrust sleeve 5 contains internal threads matching the fine threads 4 on the screw plug. On two diametrically opposite sides, the downholder flange 7 is provided with recesses 8 which extend across the width of the flange and have a V-shaped cross section including an angle of about 120°. The recesses 8 serve for tightly holding the pipe 1 and they prevent the surface of the pipe from being damaged.

The thrust sleeve 5 is associated with a telescopic guide means 9 consisting of two tubular members 10 symmetrically attached to the thrust sleeve parallel to the screw plug 3, and of a U-shaped stirrup 11 having parallel legs 12 slidably received into the tubular member 10. The position of the legs 12 inside the tubular member 10 is shown in phantom. The legs 12 slide easily in the tubular member 10. The yoke of the stirrup 19 contains a fitting 13 for the reception of a torque converter 14. This fitting 13 contains a hexagonal bore and carries a clamping screw 15.

The torque converter 14 comprises a body 16 with a coaxial extension 17 towards the screw plug 3 and the extension has a hexagonal external cross section that fits into the internal hexagonal cross section of the fitting 13. The extension 17 is thus coupled to the stirrup 11 and the latter to the thrust sleeve 5 so that no relative rotation can occur. In other words, the differential torque experienced by the body 16 of the torque converter 14 is taken up and transmitted to the thrust sleeve 5 which is fixed in position.

The extension 17 contains a coaxial bore, not shown, containing the output shaft 18 of the torque converter 14. The bottom end of the output shaft 18 contains a hexagonal socket adapted to receive the hexagonal upper end, not shown, of the screw plug 3. In the upward direction the torque converter 14 has a projecting input shaft 19 likewise provided with a hexagonal or square end to which a rachtet wrench 20 having a lever arm 21 and a handle 22 can be applied. The length of the lever arm is shown considerably reduced in the drawing. A transmission which greatly increases the torque couples the input shaft 19 to the output shaft 17. The torque converter is of substantially axially symmetrical and of very compact design. The drawing also shows that the offset included in the geometry of the stirrup legs 12 reduces the lateral dimensions at the top of the stirrup 11 to within the diameter of the body 16 of the torque converter 14.

The arrangement so far described is an extremely compact tool which can be used for forming necked-out nipples.

In order to permit the necking out tool to be reliably mounted on a pipe 1, two tensioning chains 23 are attached to one side of the downholder flange 7 for transmitting the pressure of the thrust sleeve 5 to the pipe 1. The other end of each tensioning chain 23 is attached to a tensioning caliper device 24 which is mounted on the opposite side of the downholder flange. The tensioning chain 23 is attached to the bottom jaw 25 of the tensioning caliper, whereas the upper jaw 26 is hooked to an abutment 27 on the downholder flange 7. The two abutments 27 are U-shaped blocks bolted to the top of the downholder flange 7. The hook connection of the jaws 26 is effected by hinge pins not visible in the drawing. The tool is tightened on the pipe by the jaws 28 and 29 of the caliper device being forced together, the jaws being prevented from re-opening by a self-locking mechanism incorporated in the caliper device.

A threaded screw plug 3 is shown in FIG. 2, and is provided with a fine thread 4. This Bolt-shaped member has, at one end, a hook-shaped forming head 30. This forming head projects from a substantially conical-shaped portion of the screw plug 3. The forming head, furthermore, has a substantially rectangular cross-section in a plane normal to the axis of the screw plug. The width of this rectangular cross-sectional area is substantially smaller than the bore in the pipe line through which the forming head is to be passed. The length of the rectangular-shaped cross-section corresponds substantially to the diameter of the final cylindrical neck. To insert the expansion head into the starting bore of the pipe line, the expansion head has an inclined slit or slot 31.

The surfaces which are effective in the actual neck forming process, are denoted by 32 and 33. These surfaces are well rounded at the transition regions or surfaces to the remaining areas of the forming head, for the purpose of allowing smooth and easy motion with respect to the material to be worked on.

The screw plug 3 is provided with a conical-shaped portion 34 at the end opposite to that having the forming head. This conical-shaped portion 34 terminates in a hexagonal portion 35 to which the output shaft 18 is applied for the purpose of turning the forming head.

The term hook-shaped is by no means limiting in respect to the geometrical form of the head. Hook-shaped includes all forms which are to be inserted into the initial bore of the pipe and have at least one dimension larger than the diameter of the bore. Thus symmetrical constructions with retractable surfaces 32 and 33 or a forming head 30 being tiltable relative to the screw plug 3 for insertion but symmetrical in the working position after insertion are also included in the invention.

I claim:

1. In a portable necking-out hand-tool for forming projecting cylindrical nipples on the circumferential wall of a pipe, container or the like, having screw plug means with hook-shaped forming head means and thrust sleeve means provided with coaxial downholder flange means for cooperation with the forming head means and the screw plug means, said thrust means having a hollow cylindrical interior corresponding to the contour of the forming head means for the reception of the formed nipple, the improvement which comprises non-rotatable, symmetrical telescopic guide means associated with the thrust sleeve means for mounting torque converter means on the screw plug means for effecting the continuous rotation of the hook-shaped forming head means, the telescopic guide means comprising two tubular members symmetrically attached to the thrust sleeve means parallel to the screw plug means, U-shaped stirrup means having parallel legs slidably received into the tubular members and yoke means incorporating a fitting for the reception of the torque converter means.

2. Necking-out tool of claim 1 wherein said fitting has a hexagonal internal cross section and the body of the torque converter means has an extension with a hexagonal external cross section adapted to fit into said internal hexagonal cross section.

3. Necking-out tool of claim 1 wherein the legs of the stirrup means have an outwardly offset shape.

4. Necking-out tool of claim 1 wherein at least one tensioning chain means is attached to one side of the downholder flange means for securing the thrust sleeve means in place, the other end of the tensioning chain means being attached to tensioning means which is connected to the opposite side of the downholder means.

5. Necking-out tool of claim 4 wherein the tensioning means is a tensioning caliper device.

* * * * *